US007388570B2

(12) United States Patent
Chao

(10) Patent No.: US 7,388,570 B2
(45) Date of Patent: Jun. 17, 2008

(54) DIGITAL CONTROLLED MULTI-LIGHT DRIVING APPARATUS

(75) Inventor: Yuan-Jen Chao, Kaohsiung (TW)

(73) Assignee: Gigno Technology Co., Ltd., Taipei (TW)

( * ) Notice: Subject to any disclaimer, the term of this patent is extended or adjusted under 35 U.S.C. 154(b) by 759 days.

(21) Appl. No.: 10/715,414

(22) Filed: Nov. 19, 2003

(65) Prior Publication Data

US 2004/0100439 A1 May 27, 2004

(30) Foreign Application Priority Data

Nov. 20, 2002 (TW) ..... 91218715 U

(51) Int. Cl.
*G09G 3/36* (2006.01)

(52) U.S. Cl. ..... 345/102; 345/204

(58) Field of Classification Search ..... 345/102, 345/103, 204; 315/210, 312, 318
See application file for complete search history.

(56) References Cited

U.S. PATENT DOCUMENTS 4,529,914 A * 7/1985 Kaneda ..... 315/335
5,272,327 A * 12/1993 Mitchell et al. ..... 250/205
5,461,397 A * 10/1995 Zhang et al. ..... 345/102
5,754,159 A * 5/1998 Wood et al. ..... 345/102
5,818,172 A * 10/1998 Lee ..... 315/86
5,854,617 A * 12/1998 Lee et al. ..... 345/102
5,892,336 A * 4/1999 Lin et al. ..... 315/291
6,060,843 A * 5/2000 Primisser et al. ..... 315/291
6,069,449 A * 5/2000 Murakami ..... 315/158
6,075,325 A * 6/2000 Kouno et al. ..... 315/307
6,104,146 A * 8/2000 Chou et al. ..... 315/277
6,201,352 B1 * 3/2001 Ge et al. ..... 315/169.1
6,243,067 B1 * 6/2001 Noguchi et al. ..... 345/102
6,243,068 B1 * 6/2001 Evanicky et al. ..... 345/102
6,420,839 B1 * 7/2002 Chiang et al. ..... 315/311
6,448,955 B1 * 9/2002 Evanicky et al. ..... 345/102
6,496,236 B1 * 12/2002 Cole et al. ..... 349/61
6,856,519 B2 * 2/2005 Lin et al. ..... 363/16
6,947,024 B2 * 9/2005 Lee et al. ..... 345/102
6,961,044 B2 * 11/2005 Woo ..... 345/102
2002/0140538 A1 * 10/2002 Yer et al. ..... 336/198
2003/0122771 A1 * 7/2003 Sumiyoshi et al. ..... 345/102
2005/0057486 A1 * 3/2005 Aoki et al. ..... 345/102

* cited by examiner

*Primary Examiner*—Amare Mengistu
*Assistant Examiner*—Eli M Sheets
(74) *Attorney, Agent, or Firm*—Birch, Stewart, Kolasch & Birch, LLP

(57) ABSTRACT

A digital controlled multi-light driving apparatus. The driving apparatus includes a plurality of oscillation step-up circuits and a digital control circuit. The digital control circuit electrically connects to each of the oscillation step-up circuits, respectively. The digital control circuit generates sets of digital switching signals, which are phase controllable and duty cycle controllable, and respectively transmits the sets of digital switching signals to the oscillation step-up circuits. The phases and duty cycles of the digital switching signals are controlled by the digital control circuit.

16 Claims, 4 Drawing Sheets

DIGITAL CONTROLLED MULTI-LIGHT DRIVING APPARATUS

This Nonprovisional application claims priority under 35 U.S.C. § 119(a) on Patent Application No(s). 091218715 filed in Taiwan on Nov. 20, 2002, the entire contents of which are hereby incorporated by reference.

BACKGROUND OF THE INVENTION

1. Field of Invention

The invention relates to a light driving apparatus and, in particular, to a digital controlled multi-light driving apparatus for a large size flat panel display.

2. Related Art

Flat panel displays have become increasingly popular in recent years, with liquid crystal displays (LCDs) garnering the most widespread acceptance. Conventional LCDs are typically employed as personal computer monitors and have a screen size of 15" or less. As manufacturing technology has developed, a variety of display sizes have come to be employed for different purposes, including use as TV displays. When employed for this purpose, a flat panel LCD with a screen size of 30" or larger is desirable. Accordingly, an LCD of this size requires a greater number of lights to provide adequate brightness. For example, an LCD with a screen size of 40" may require up to 30 lights.

When the number of lights is increased, however, an accompanying problem of poor brightness uniformity between lights arises. In addition, the number of light driving apparatuses for driving the lights is also increased. For example, regarding the conventional light driving apparatus, usually only two cold cathode fluorescent lamps (CCFLs) can be driven at the same time by one transformer. Thus, for an LCD with a large screen size requiring increased number of lights, the number of required light driving apparatuses is also increased, and manufacturing costs thereof increase as a result.

As previously mentioned, the conventional LCD typically employs CCFLs as backlights thereof. To induce the CCFL or CCFLs to emit light, a light driving apparatus with an inverter is typically used. Referring to FIG. 1, a conventional light driving apparatus 8 mainly includes a current adjusting circuit 81, an oscillation step-up circuit 82, a detecting circuit 83, and a feedback control circuit 84.

The current adjusting circuit 81 is controlled by the feedback control circuit 84 and properly adjusts an external DC source, which is then input to the oscillation step-up circuit 82. The oscillation step-up circuit 82 converts the input DC source into an AC signal and amplifies the AC signal. The amplified AC signal is then provided to the CCFL 9, which serves as the light, so that the CCFL 9 can then emit light. Furthermore, the detecting circuit 83 detects a feedback signal, such as a current signal or a voltage signal, from one end of the CCFL 9. The feedback signal is then transmitted to the feedback control circuit 84. The feedback control circuit 84 controls the current adjusting circuit 81 according to the feedback signal, so that the current adjusting circuit 81 can output a suitable current level. It should be noted that the conventional feedback control circuit 84 is an analog feedback control circuit.

When the number of lights is increased, the number of required light driving apparatuses 8 is increased accordingly. In an LCD with a large screen size, a plurality of circuits, each of which includes the current adjusting circuit 81, oscillation step-up circuit 82, detecting circuit 83 and feedback control circuit 84, are necessary at the same time. Since the lights are driven by different driving apparatuses 8, which are independent from one another, the brightness uniformity adjustment or phase matching between lights cannot be efficiently achieved, resulting in poor display quality.

Therefore, it is an important subjective to prevent the above-mentioned problems, so as to improve the quality of an LCD with a large screen size and reduce manufacturing costs.

SUMMARY OF THE INVENTION

In view of the above-mentioned problems, an objective of the invention is to provide a digital controlled multi-light driving apparatus, which is easily manufactured and can control the phases and brightness of numerous lights.

To achieve the above-mentioned objective, a digital controlled multi-light driving apparatus of the invention includes a plurality of oscillation step-up circuits and a digital control circuit. The digital control circuit electrically connects to each of the oscillation step-up circuits, and generates sets of digital switching signals, which are phase controllable and duty cycle controllable. The digital control circuit then respectively transmits the sets of the digital switching signals to the oscillation step-up circuits. The phase and duty cycle of each set of digital switching signals are controlled by the digital control circuit. The digital control circuit controls the duty cycle of each set of digital switching signals according to the feedback signals from plural lights.

Since the digital controlled multi-light driving apparatus of the invention employs just one digital control circuit to control a plurality of oscillation step-up circuits, the conventional current adjusting circuit 81 is omitted and it is not necessary to use the feedback control circuit 84 repeatedly. In other words, the digital controlled multi-light driving apparatus of the invention has a simple structure, resulting in reduced manufacturing cost. Furthermore, the digital controlled multi-light driving apparatus has a digital control circuit for generating sets of digital switching signals, which are phase controllable and duty cycle controllable. The oscillation step-up circuits can be controlled according to the sets of digital switching signals, so that the phases and brightness of different lights can be respectively controlled so as to improve display quality.

BRIEF DESCRIPTION OF THE DRAWINGS

The invention will become more fully understood from the detailed description given hereinbelow illustrations only, and thus are not limitative of the present invention, and wherein.

DETAILED DESCRIPTION OF THE INVENTION

The digital controlled multi-light driving apparatus according to the preferred embodiments of the invention will be described herein below with reference to the accompanying drawings.

Figure 1:
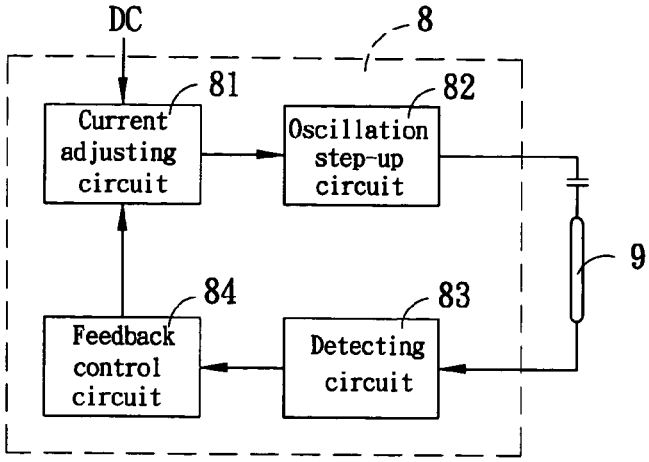
PRIOR ART FIG. 1
FIG. 1 is a block diagram showing a conventional light driving apparatus.
Figure 2:
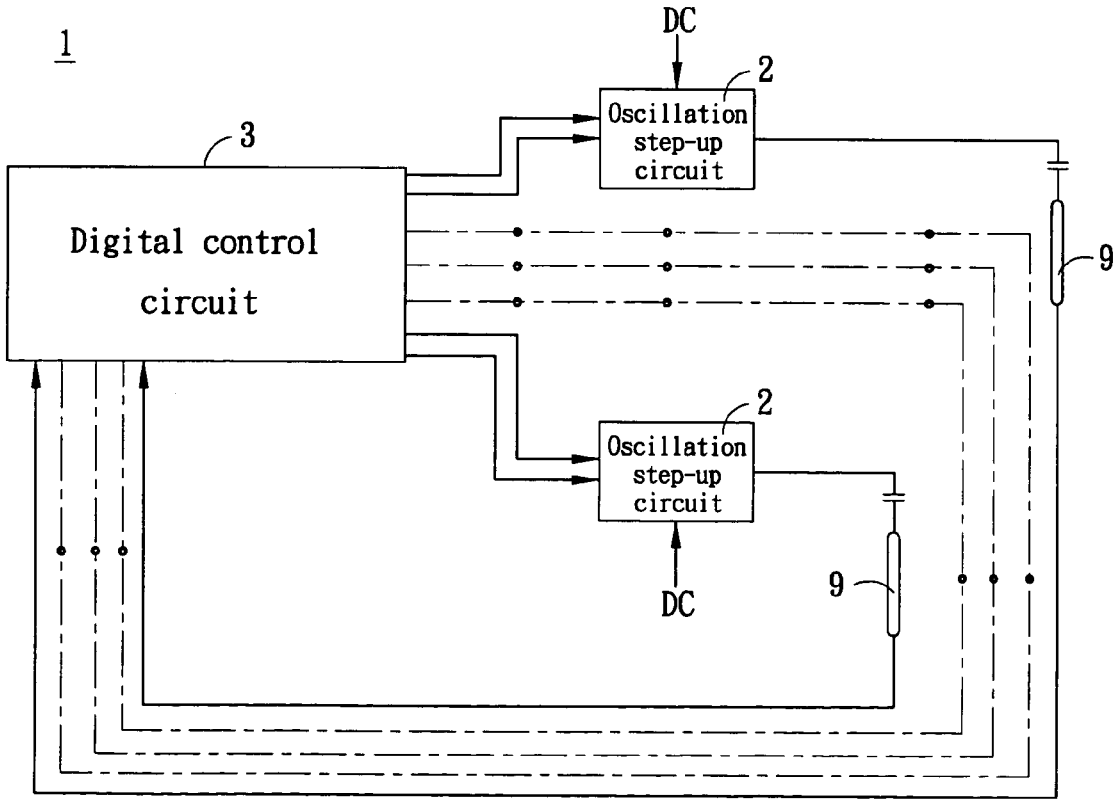
FIG. 2 is a block diagram showing a digital controlled multi-light driving apparatus according to a preferred embodiment of the invention.

Referring to FIG. 2, a digital controlled multi-light driving apparatus 1 includes a plurality of oscillation step-up circuits 2 and a digital control circuit 3.

Figure 3:
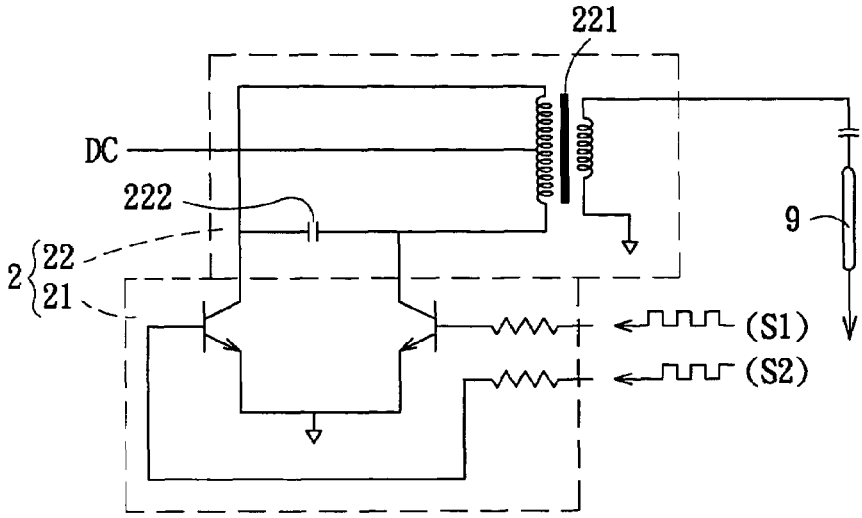
FIG. 3 is a schematic illustration showing an oscillation step-up circuit of the digital controlled multi-light driving apparatus of the invention.

The digital control circuit 3 electrically connects to the oscillation step-up circuits 2, respectively. The digital control circuit 3 further generates sets of digital switching signals S1 and S2 (as shown in FIG. 3), which are phase controllable and duty cycle controllable, and respectively transmits the sets of the digital switching signals S1 and S2 to the oscillation step-up circuits 2. The phase and duty cycle of each set of digital switching signals S1 and S2 are controlled by the digital control circuit 3.

With reference to FIG. 3, each oscillation step-up circuit 2 includes a switching unit 21 and a resonance step-up unit 22. In the present embodiment, the switching unit 21 includes two bipolar transistors and two resistors. One end of each resistor connects to the base electrode of each corresponding bipolar transistor, and the other end of each resistor connects to the digital control circuit 3 for receiving the digital switching signals S1 and S2. The resonance step-up unit 22 mainly consists of a transformer 221 and a capacitor 222. The two ends of the capacitor 222 electrically connect to the collectors of the bipolar transistors, respectively. Moreover, the resonance step-up unit 22 may at least electrically connect to one cold cathode fluorescent lamp (CCFL) 9, which serves as the light. It should be noted that the switching unit 21 may also consist of two MOS transistors (not shown). In this case, the digital switching signals S1 and S2 input from the digital control circuit 3 are used to control the gates of the MOS transistors.

Figure 4:
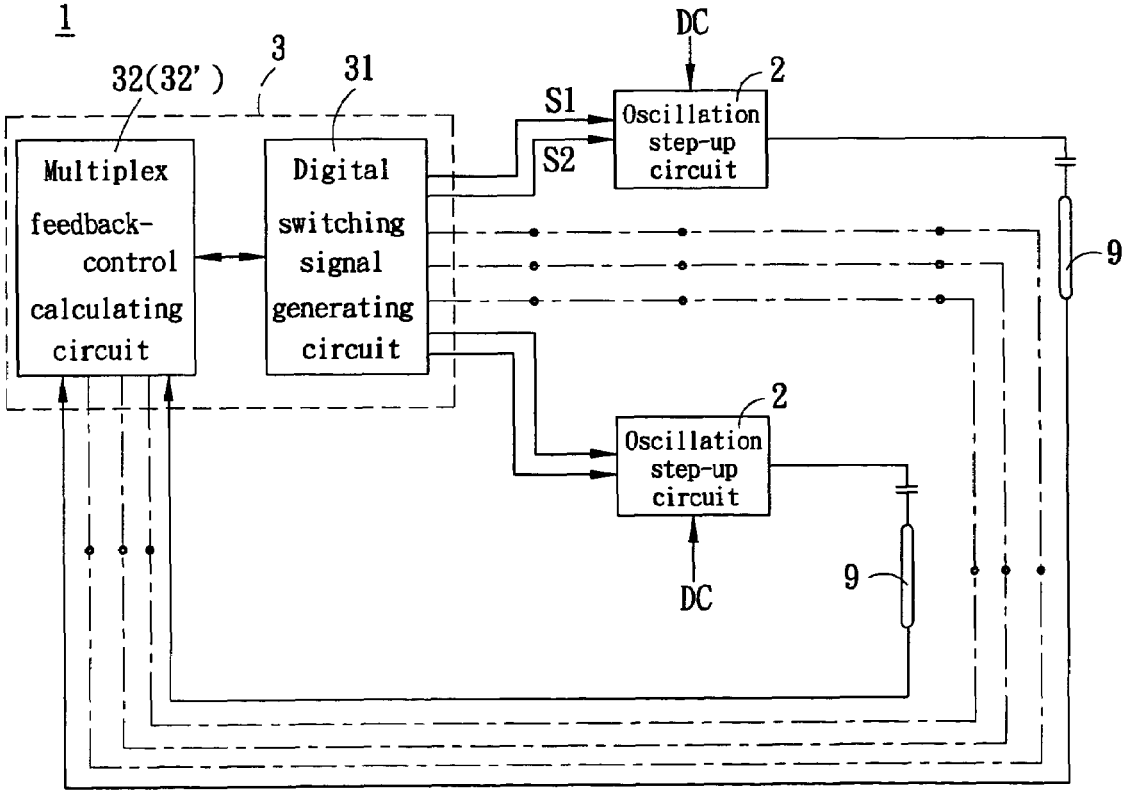
FIG. 4 is a block diagram showing a digital controlled multi-light driving apparatus according to an additional preferred embodiment of the invention.

With reference to FIG. 4, the digital control circuit 3 includes a digital switching signal generating circuit 31 and a multiplex feedback-control calculating circuit 32.

The digital switching signal generating circuit 31 electrically connects to each of the oscillation step-up circuits 2, and generates sets of digital switching signals S1 and S2, wherein the sets of the digital switching signals S1 and S2 are transmitted to the oscillation step-up circuits 2, respectively. The multiplex feedback-control calculating circuit 32 controls the digital switching signal generating circuit 31. The multiplex feedback-control calculating circuit 32 further controls the duty cycles of the sets of digital switching signals S1 and S2 according to the feedback signals of the CCFLs 9. In the current embodiment, the feedback signal of each CCFL 9 can be a current signal or a voltage signal.

Figure 5:
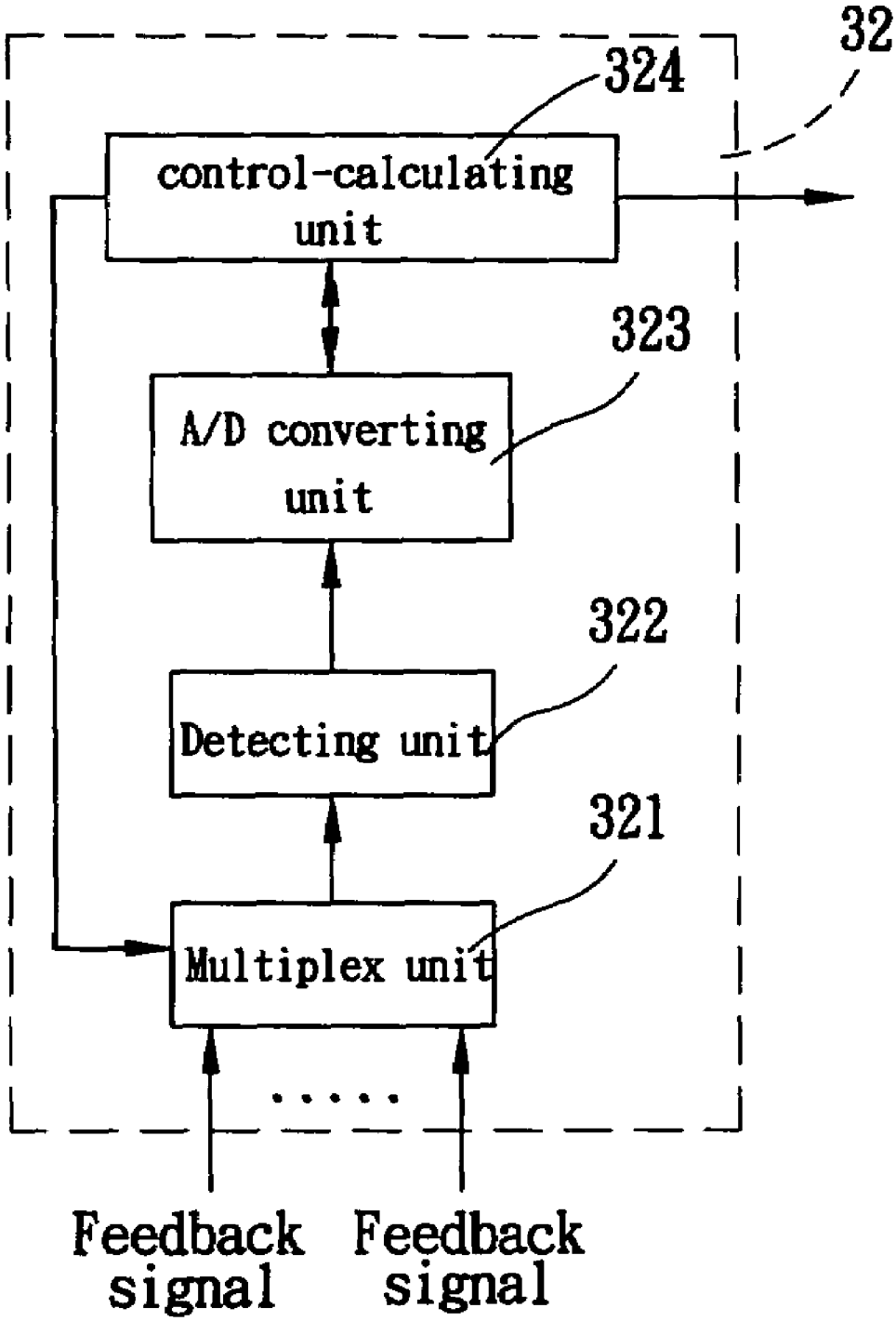
FIG. 5 is a block diagram showing a multiplex feedback-control calculating circuit of the digital controlled multi-light driving apparatus of the invention.

Referring to FIG. 5, the multiplex feedback-control calculating circuit 32 includes a multiplex unit 321 electrically connecting to each of the CCFLs 9 (the lights), a detecting unit 322 for detecting the feedback signals from the CCFLs 9 (the lights), an A/D converting unit 323 to respectively convert the feedback signals into digital feedback signals, and a control-calculating unit 324 to control the digital switching signal generating circuit 31 according to the digital feedback signals. The control-calculating unit 324 further controls the multiplex unit 321, so that the multiplex unit 321 can pick one of the feedback signals to be detected. In practice, the multiplex feedback-control calculating circuit 32 can be a single-chip microprocessor.

Figure 6:
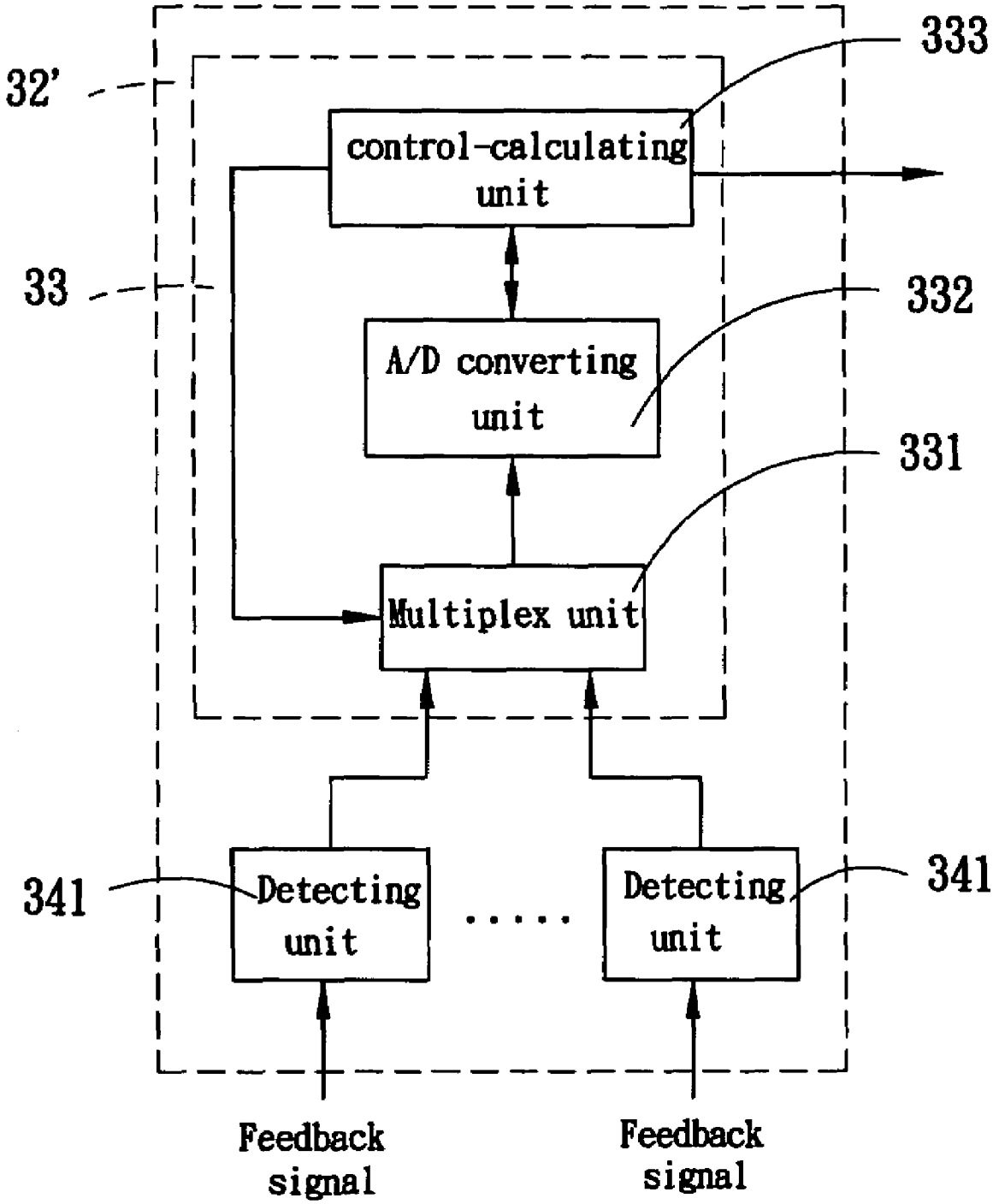
FIG. 6 is a block diagram showing a multiplex feedback-control calculating circuit according to an additional embodiment of the invention.

In an additional embodiment of the invention, the multiplex feedback-control calculating circuit may be implemented as shown in the block diagram of FIG. 6. The multiplex feedback-control calculating circuit 32' includes a single-chip microprocessor 33 and a plurality of detecting units 341. The single-chip microprocessor 33 includes a multiplex unit 331, an A/D converting unit 332, and a control-calculating unit 333. The detecting units 341 are electrically connected to the CCFLs 9 (the lights), respectively, so as to detect the feedback signals from the CCFLs 9.

In summary, since the digital controlled multi-light driving apparatus 1 of the invention only employs one digital control circuit 3 to control a plurality of oscillation step-up circuits 2, the conventional current adjusting circuit 81 is unnecessary and omitted. Furthermore, the conventional feedback control circuit 84 is not repeatedly used. In other words, the digital controlled multi-light driving apparatus 1 of the invention has a simple structure, and therefore is less costly to manufacture. Moreover, the digital controlled multi-light driving apparatus 1 has a digital control circuit 3 for generating sets of digital switching signals, which are phase controllable and duty cycle controllable. The oscillation step-up circuits 2 can be controlled according to the sets of digital switching signals, so that the phases and brightness of different lights can be respectively controlled to improve the display quality of an LCD.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A digital controlled multi-light driving apparatus for driving and controlling a plurality of lights, comprising:

a plurality of oscillation step-up circuits; and a digital control circuit, which has a digital switching signal generating circuit and a multiplex feedback-control calculating circuit, the digital switching signal generating circuit connects to each of the oscillation step-up circuits, generates sets of digital switching signals, and respectively transmits the sets of the digital switching signals to the oscillation step-up circuits, wherein the multiplex feedback-control calculating circuit has a control-calculating unit and an A/D converting unit, the control-calculating unit controls the digital switching signal generating circuit, and controls a phase and a duty cycle of each set of the digital switching signals generated by the digital switching signal generating circuit according to digital feedback signals from the A/D converting unit, the A/D converting unit converts feedback signals from the lights into the digital feedback signals, respectively, wherein the oscillation step-up circuits are controlled according to the sets of digital switching signals, respectively.

2. The driving apparatus of claim 1, wherein each of the oscillation step-up circuits is electrically connected to at least one of the lights.

3. The driving apparatus of claim 1, wherein the lights are cold cathode fluorescent lamps (CCFLs).

4. The driving apparatus of claim 1, wherein each of the oscillation step-up circuits comprises a switching unit and a resonance step-up unit, the switching unit electrically connects to the digital control circuit and performs switching according to one corresponding set of the digital switching signals output from the digital control circuit, and the resonance step-up unit is controlled by the switching unit.

5. The driving apparatus of claim 4, wherein the resonance step-up unit comprises a transformer and a capacitor.

6. The driving apparatus of claim 5, wherein the switching unit comprises two transistors, the transistors electrically connect to the two ends of the capacitor, respectively, and the transistors are turned on/off according to the corresponding set of the digital switching signals.

7. The driving apparatus of claim 6, wherein the transistors of the switching unit are MOS transistors.

8. The driving apparatus of claim 6, wherein the transistors of the switching unit are bipolar transistors.

9. The driving apparatus of claim 8, wherein the switching unit further comprises two resistors, one end of each of the resistors electrically connects to the base electrode of each corresponding transistor, respectively, and the other end of each of the resistors electrically connects to the digital control circuit.

10. The driving apparatus of claim 1, wherein the multiplex feedback-control calculating circuit is a digital single-chip microprocessor.

11. The driving apparatus of claim 1, wherein the multiplex feedback-control calculating circuit comprises:

a multiplex unit, which electrically connects to each of the lights;

a detecting unit, which electrically connects to the multiplex unit to detect the feedback signals from the lights, wherein the A/D converting unit converts the feedback signals into digital feedback signals, respectively, and the control-calculating unit controls the multiplex unit, and further controls the digital switching signal generating circuit according to the digital feedback signals.

12. The driving apparatus of claim 1, wherein the multiplex feedback-control calculating circuit comprises:

a plurality of detecting units, which electrically connect to the lights and detect the feedback signals respectively input from the lights; and a multiplex unit, which electrically connects to each of the detecting units, wherein the A/D converting unit electrically connects to the multiplex unit and converts the feedback signals into digital feedback signals, respectively, the control-calculating unit controls the multiplex unit, and further controls the digital switching signal generating circuit according to the digital feedback signals.

13. The driving apparatus of claim 12, wherein the multiplex unit, the A/D converting unit, the control-calculating unit are integrated in a digital single-chip microprocessor.

14. The driving apparatus of claim 12, wherein the A/D converting unit, the control-calculating unit are integrated in a digital single-chip microprocessor.

15. The driving apparatus of claim 1, wherein the feedback signals are current signals.

16. The driving apparatus of claim 1, wherein the feedback signals are voltage signals.

* * * * *